US005888179A

United States Patent [19]

Singhal

[11] Patent Number: 5,888,179

[45] Date of Patent: Mar. 30, 1999

[54] AGILITY EXERCISE APPARATUS

[76] Inventor: Tara Chand Singhal, P.O. Box 5075, Torrance, Calif. 90510

[21] Appl. No.: 469,894

[22] Filed: Jun. 5, 1995

[51] Int. Cl.[6] ..... A63B 5/00

[52] U.S. Cl. ..... 482/81; 482/3; 434/247

[58] Field of Search ..... 482/1–9, 900–902, 482/83–86, 81; 434/112, 247, 250, 257

[56] References Cited

U.S. PATENT DOCUMENTS

| | | | |
|---|---|---|---|
| 4,728,100 | 3/1988 | Smith | 482/3 |
| 4,813,665 | 3/1989 | Carr | 482/81 |
| 5,120,228 | 6/1992 | Stahl et al. | 434/112 X |

FOREIGN PATENT DOCUMENTS

| | | | |
|---|---|---|---|
| 1203258 | 4/1986 | Canada | 482/84 |
| 0689684 | 10/1979 | U.S.S.R. | 482/84 |

*Primary Examiner*—Glenn E. Richman

*Attorney, Agent, or Firm*—Nydegger & Associates

[57] ABSTRACT

An exercise apparatus for exercising and enhancing human agility and reaction time skills involving the mental and physical ability to act quickly and move rapidly in reacting to events and objects that invade the space immediately surrounding a person. The apparatus has one or more bases surrounding the area where the subject stands. The bases generate visible bars of light at all heights and orientations. The subject has to jump over, or duck his body to avoid intercepting the light bars. The motion of the bars is supplemented by audio which adds motion sounds as well as musical tones. The height. the rate of motion of the bars along with the orientation of their movement is settable and controllable by the user in periodic and random modes. Means are provided that enable the light bar to come to a stop against the body of the exercise subject like a physical bar. In the electronic Blocker version, an electronic Blocker with light sensors and wireless signal transmission, is used to block the light bar and restart the sweep of the light bar at a new orientation.

23 Claims, 5 Drawing Sheets

AGILITY EXERCISE APPARATUS

BACKGROUND

There are exercise machines of various kinds that are used for exercising the human body. These machines use many varieties of exercise techniques such as: lifting weight; simulating sport actions of rowing, skiing, bicycling; other means of exercise like stair climbing and walking. These and similar machines exercise the body in general and different muscle groups and parts of the body in particular.

These exercise machines do not specifically exercise and develop the agility of the human body. The human agility is the ability to act quickly and move rapidly using both mental and physical skills in reacting to events and objects that invade the space immediately surrounding a person. The agility skills when developed through an exercise apparatus are useful in improving reaction time skills and providing physical exercise. They may also be useful in improving the competition ability in some sports.

SUMMARY

The present invention is directed to an exercise apparatus which is useful in developing human agility and also provides physical exercise. The human agility, embodying the ability to act quickly and move rapidly using both mental and physical skills in reacting to events and objects that invade the space immediately surrounding a person, is an important aspect of exercising. The agility skills when developed through this exercise apparatus are useful in giving the body a balanced mental and physical exercise as well as in improving the competition sport ability. It is believed that, this exercise apparatus enables a heightened mental state of awareness and readiness while indulging in physical exercise of the body, thereby providing a balanced exercise to the exercise subject.

This apparatus uses light beams, preferably laser light beams, that are modified to visually appear as solid physical bars that sweep over an area where the exercise subject stands. A pencil beam of laser light, capable of travelling hundreds of feet is reduced in intensity by fattening it to about one to one and half inches in diameter, that need travel only about ten to twenty feet. This modified light beam with proper ambient lighting and haze makes a visible light bar that appears like a solid bar. These light bars sweep over the area where the exercise subject interacts with them. One form of interaction is by jumping, ducking or moving sideways to avoid the light bar from hitting the body. Another form of interaction is to block the light bar using an electronic blocker. The height, the rate of sweep along with the orientation of the sweep of the light bars is set to different settings and controlled by the user in periodic and random modes.

The sweep of the light bars is, preferably, supplemented by audio which adds sounds such as swishing sound as well as musical tones. The area which the subject occupies can be enhanced by the addition of a suitable padded platform that assists the subject in jumping as well as in cushioning his fall from the jump.

In one version of the exercise apparatus, one or more knee high bases surrounding the area where the subject stands generate horizontal bars of light. These bases generate light bars which are set at varying heights, generally from ankle level to below knee level, and at varying speeds, sweep over the area. The subject has to jump over the bars to avoid hitting or intercepting them. The exercise subject has to be mentally alert as well as physically able to jump different heights to coordinate his timing of jump and the degree of height of jump to coincide with the bars that sweep over the area. In one version of the apparatus, the sweep of the light bars is sensed by a sensor to generate an advisory indication and stop the light bar's sweep if the bar hits the legs of the exercise subject, because he was unable to jump over the bars.

In another version of the exercise apparatus, one or more head high bases, surrounding the area where the subject stands generate light bars at all heights and orientations relative to the subject. The subject has to duck his head, jump, or move his body sideways to avoid hitting or intercepting the bars.

In yet another version of the exercise apparatus, the exercise subject uses a hand held electronic blocker, which he uses to block the light bars. The blocker has light sensor means on its surface and wireless signal transmitting means embedded in it. The sensor means detect the light bar hitting the blocker and then send a wireless signal to the base. The reception of the signal by the base activates means to stop the light bar sweep and then restart the light bar sweep from a different orientation.

The electronic blocker can be in many forms. A preferable blocker form is a rod shape even though many other shapes are possible.

The exercise apparatus has programmable means for the exercise subject to set and control the exercise apparatus by controls on the bases as well as via remote control enabling him to customize and fine tune his exercise regimen.

DRAWINGS

These and other features, aspects and advantages of the present invention will become better understood with regard to the following description, appended claims and accompanying drawings, where:

DESCRIPTION

Figure 1A:
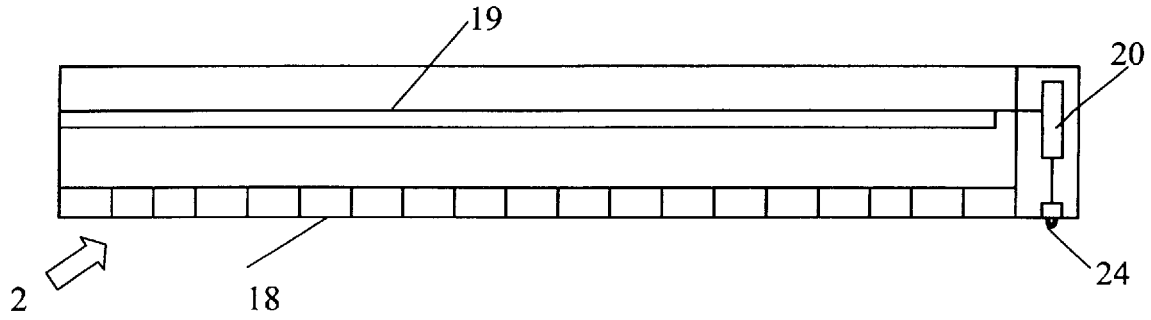
FIG. 1A shows a plan view of a version of the first base showing light bar generating means and a version of the second base showing light bar detection means.

An agility exercise apparatus, which is useful in developing agility and also provides physical exercise to the body, is described. In this apparatus, light beams modified to visually appear as solid physical bars, are used. The exercise subject occupies an area in a defined volume of space, to interact with the light bar for the purpose of agility exercising. One form of interaction is that as the light bars sweep over the area the exercise subject moves his body by jumping, ducking or moving sideways to avoid the light bar from hitting his body. While in an another form of interaction, an electronic blocker held by the exercise subject is used to block the light bar sweep.

The agility exercise apparatus has one or more bases positioned around the area suitable to be occupied by the exercise subject. The base generates light bars and incorporates means to detect impact of the light bar against the body of the exercise subject and generate an advisory indication as well as make the sweep of the bar come to a stop against the body giving the appearance that the bar is made of a solid construction.

The exercise apparatus consists of a first base (1), preferably a second base (2) and in some versions an electronic blocker (3).

The first base is described with reference to FIG. 1. It shows: a light source, preferably a laser light source (4), generating a narrow focussed beam of light (5); reflecting mirrors in the beam's path to directionally alter the beam path (6); haze creating means with haze dispensing ports (7), which atomize a vegetable oil based liquid directly in front of the first base; a conical mirror assembly (8) for fattening the light beam and converting it to a light bar, as it exits the base; and a light bar sweep control means (9) using an electrical circuit with electromagnet for controlling tilt motion of the conical mirror assembly, such that the light bar as it exits the base, can be made to move in the space directly in front of the base. Prior art on use of lasers in entertainment teaches means for laser beam reflection and means for laser beam motion control for visual entertainment effects.

The fattened light beam is termed "light bar" (10) which is a bar of light with its outer diameter roughly one to one and half inches. Combination of the haze and subdued ambient lighting in front of the base, makes the light bar visible, making it appear as a physical bar (10). Fattening the laser beam reduces its light intensity, and converts it from a narrow pencil beam capable of travelling hundreds of feet to one that only need travel of the order of ten to twenty feet.

The conical mirror assembly (8) has an inner (11) and an outer conical mirror (13). The inner conical mirror (11), with its reflecting surface on the outside, and an apex end and a flare end, is attached to the outer conical mirror by plates (12) near the flare end. The outer conical mirror (13), with its reflecting surface on the inside, surrounds the inner conical mirror. The outer conical mirror has a cutoff apex end and a flare end and is attached to the assembly housing at its cutoff end. The assembly also has a flat mirror (14), which reflects the beam on to the apex end of the inner conical mirror.

In this assembly the beam of light, when pointed at the apex of the inner conical mirror, is dispersed in a 360 degree angle and at the same time reflected away. The dispersed and reflected beam then hits the inner surface of the outer conical mirror and is reflected inward, resulting in an annular beam coming out of the assembly (10). The inner and outer conical mirror surfaces are parallel to each other, keeping the light bar orientation as it exits, same as the light beam orientation as it hits the inner conical mirror. The diameter of the fattened beam is dependent upon the distance between the inner and the outer conical mirrors.

An audio means (36) also exists to generate audio dependent upon the light bar movement. Sweeping of the light bars over the area is accompanied by sound corresponding to their motion. The sound can be in the form of swishing sound to mimic the motion of a physical bar as well as musical tones.

The first base is equipped with a logic circuit (15). The logic circuit is embedded in the base and performs the functions described here.

The logic circuit processes user commands for program and control of the exercise apparatus. It saves default and user programmed parameters settings. User commands define the sweep rate and orientation of the light bar motion, along with type of accompanying audio. The light bar sweep rate is repeatable in periodic or random patterns. These inputs are processed to produce commands to the light bar sweep control means (9) and the audio means (36).

A receiver mechanism (16) to receive signals from the light bar obstruction sensors also exist in the first base. The light bar obstruction detection means (19), in the second base (2), sense obstruction of light bars by the exercise subject, and communicate a signal, via a transmit mechanism (24), to the first base. The preferable communication means between the first base and the second base is infrared, even though other means are possible. This signal is received by the receiver mechanism (16) in the first base and is processed by the logic circuit (15) to generate an advisory indication via audio means (36) and also in controlling the light bar sweep control means (9) which responds by stopping the sweep of the light bar substantially against the body of the exercise subject.

The logic circuit also processes signals transmitted by the blocker (3) and received by the receiver mechanism in the first base to control the light bar sweep control means and audio means. Therefore, the logic circuit inputs are: light bar sweep rate, light bar sweep boundary, light bar sweep orientation, audio tone selection, light bar start, stop, freeze, user remote control commands, and receiver mechanism output. The outputs are: light bar sweep control signals to light bar sweep control means, audio commands to audio means, and control commands for haze generating means and light source.

Figure 1A:
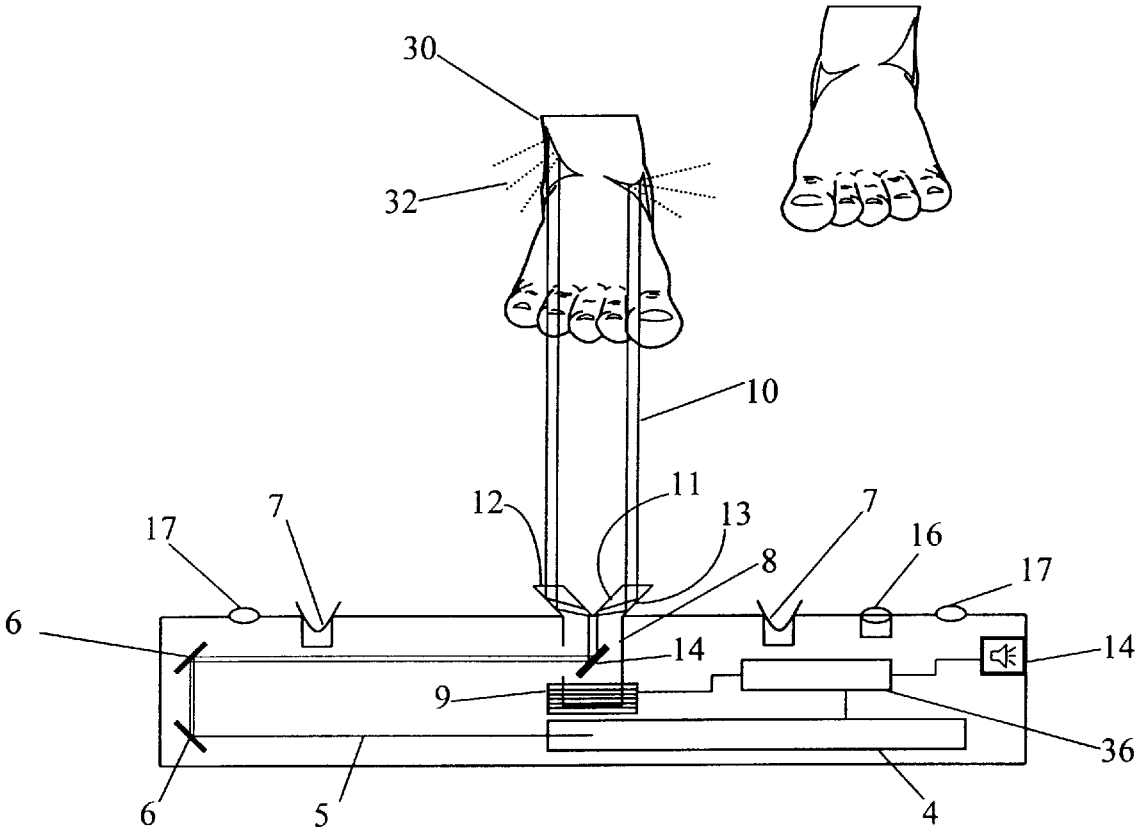

The second base (2) has means to detect the light bar's sweep obstruction by an exercise subject where the light bar is sweeping over an area. FIG. 1 and 2A show different means to detect obstruction of light bar using the second base. FIG. 2B shows means using the electronic blocker. These can be used alternatively or in conjunction with each other. They are described as follows:

In FIG. 1, the first base has a plurality of spaced apart photo detectors (17). When the light bar hits the limb of a subject (30), there is scattering of light (32) from the light bar, some of which is reflected in the direction of the first base, where the photo detectors (17) pick up the reflection. Prior art on photo detector technology is such that detectors are sensitive and cost effective for this purpose, and used in many other applications. The output of the spaced apart detectors is summed, to improve the ability of such detectors to pick up any scattered light from the light bar hitting a limb. When the light bar does not hit a limb, it is terminated by hitting the second base (2) which does not reflect light away. This enhances the contrast of scattered light received by the photo detectors.

In FIG. 1, the second base, situated opposite the first base, has a front made of a reflective grating (18). A photo cell panel (19) is placed behind the grating. The grating reflects light from the light bar at off 90 degree angles on to the photo cell panel placed behind the grating. An electrical circuit in the second base (20) detects an amount of continuous flow of current in the photo cell panel from the light of the light bar hitting it, except when the light bar is obstructed by a limb in its path. That obstruction in the light bar is detected in the form of a pulse in electrical current being generated by the electrical circuit, and the pulse is detected to indicate blocking of light bar by a body limb of the exercise subject.

In FIG. 2A, the second base, situated opposite the first base, also has a front made of reflective grating (18), behind which are placed light chanelers (21) connected to fibre optic cables (22). The other ends of fibre optic cables are terminated in a photo cell (23), which is connected to an electrical circuit (20). The light chanelers are hollow cones with reflective inner surfaces that channel the light from a large area to the cones's base where the fibre optic cable starts. The electrical circuit would detect current continuously from the light bar light in the fibre optic cables except when the light bar is obstructed by a body limb of the exercise subject. This generates a pulse in electrical current within the electrical circuit and is detected to indicate blocking of light bar by a body limb of the exercise subject.

The reflective grating in the second base is made of a grid of perpendicularly oriented reflecting surfaces (33) and it assists in directing the maximum amount of light from the light bar on to the light detecting means in the form of photo cells or fibre optic cable, which are placed behind the grating.

The transmit mechanism (24) in the second base generates a transmit signal. The first base has the receiver mechanism (16), whereby, the transmit signal is received by the receiver mechanism, and is connected to the logic circuit, which controls the light bar sweep control means, and it responds by affecting the light bar sweep orientation.

An electronic blocker (3) may also be used in certain exercise modes, where the subject uses it to block the light bar. FIG. 2B shows the electronic blocker in a rod shape consisting of a cylindrical body (25). The cylinder surface is covered with photo cells (26). These photo cells are connected to an electrical circuit (20) detects a small amount of flow of current from the light bar hitting the blocker. The electrical circuit detects current momentarily from the light bar when it intercepts the blocker.

The preferred form of the blocker is form of a rod (25), even though other shapes such as a flat object are possible. It can also be in the form of wearable articles, such as glove and sock (27) as shown in FIG. 5B. They have a plurality of light sensors on a substantial portion of their surface (28) and signal transmission mechanism (29) embedded in the blocker. The transmit signal from the blocker can be encoded to specify the blocker the signal emanated from, if more than one blocker is used. The encoded signal received at the first base assists in changing the sweep orientation of the light bars.

When, the light bar comes in contact with the blocker, the photo cells sense the contact of the light bar to the blocker. The transmit mechanism of the blocker (29) generates a transmit signal. The first base has the receiver mechanism (16), whereby, the transmit signal is received by the receiver mechanism, and is connected to the logic circuit, which controls the light bar sweep control means, and it responds by affecting the light bar sweep orientation.

The transmit mechanism (29) in the blocker is preferably infra red. For a blocker, the infrared signal is transmitted to cover 360 degrees so that holding the blocker in any manner would still enable the reception of the signal by the receiver mechanism in the first base. The preferred way to achieve 360 degree signal transmission is to place four or more transmitter bulbs equally spaced apart in a circular band on the two ends of the blocker (31). This way, no mater how the blocker is held, the first base would be receiving the infrared signal.

For a light bar sweeping at the speed of 100 ft/sec, the light bar would travel 1.2 inches in one milli second. It is believed that the light bar obstruction detection means and transmit mechansim would operate in roughly one milli second time to detect the current pulse and transmit a signal. For light bar obstruction detection by one of these methods, it is believed, the time window of the light bar being interrupted is adequate for its detection.

It is believed, that 100 feet/second speed is near the upper limit of human capability to react to an object approaching towards them at that speed from a distance of five to ten feet. For a light bar approaching from a ten feet distance, the exercise subject has the time of 1/10th of a second to perceive, react and move to avoid or block the light bar, if the light bar sweep rate is set to upper limit rate of 100 feet/second.

Figure 1B:
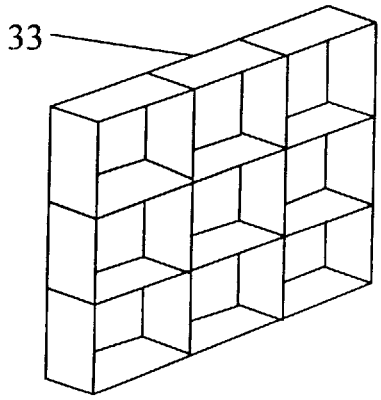
FIG. 1B shows a perspective view of a portion of a grid of perpendicularly oriented reflecting surfaces.
Figure 2A:
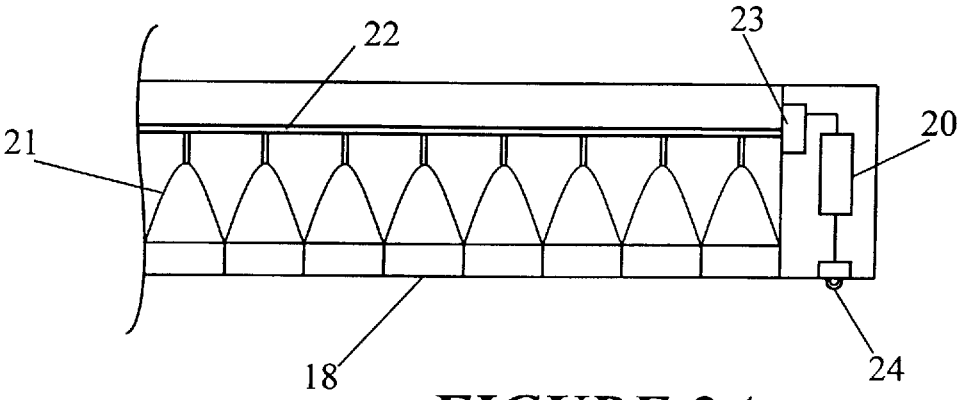
FIG. 2A shows a plan view of version of the second base showing alternative means for light bar detection.
Figure 2B:
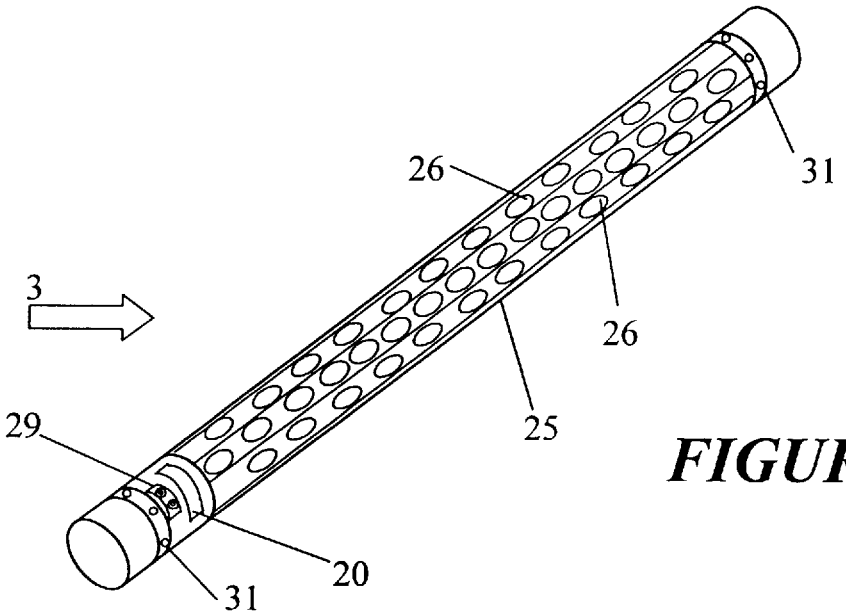
FIG. 2B shows a perspective view of a version of the electronic blocker.
Figure 3A:
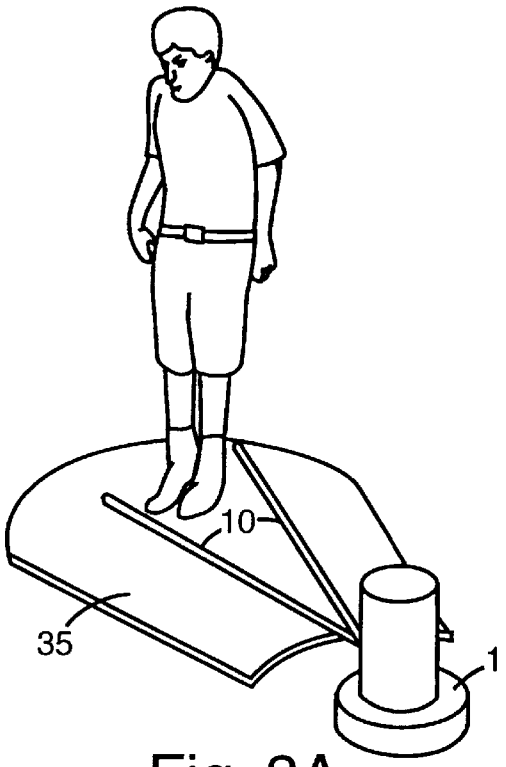
FIG. 3A shows a perspective view of a version of the exercise apparatus with the first base.
Figure 3B:
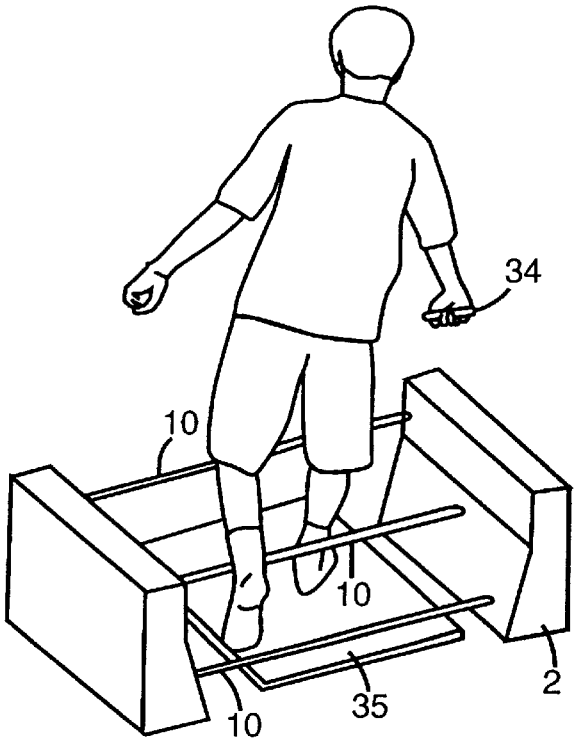
FIG. 3B shows a perspective view of a version of the exercise apparatus with the first base and the second base.

In one mode of exercise apparatus, see FIGS. 3A and 3B, one or more knee high bases surrounding the area where the subject stands generate horizontal bars of light. These light bars, set at varying heights, generally below knee level, and at varying speeds, sweep over the area. The subject has to jump over the bars to avoid hitting or intercepting them. FIG. 1B shows two bases positioned in the vicinity of the area to be occupied by the exercise subject, while FIG. 1A shows one base.

Figure 4A:
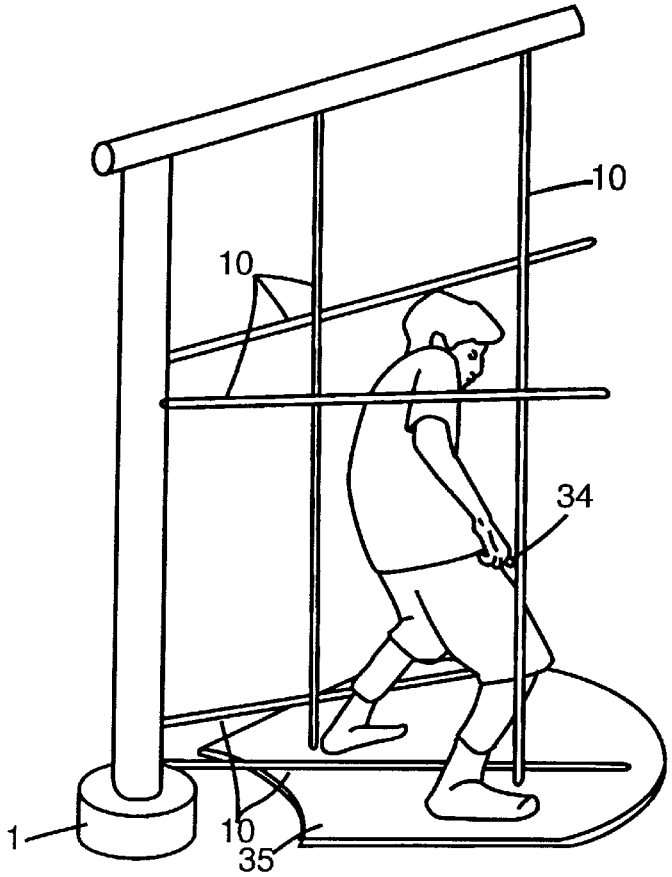
FIG. 4A shows a perspective view of another version of the exercise apparatus with the first base.
Figure 4B:
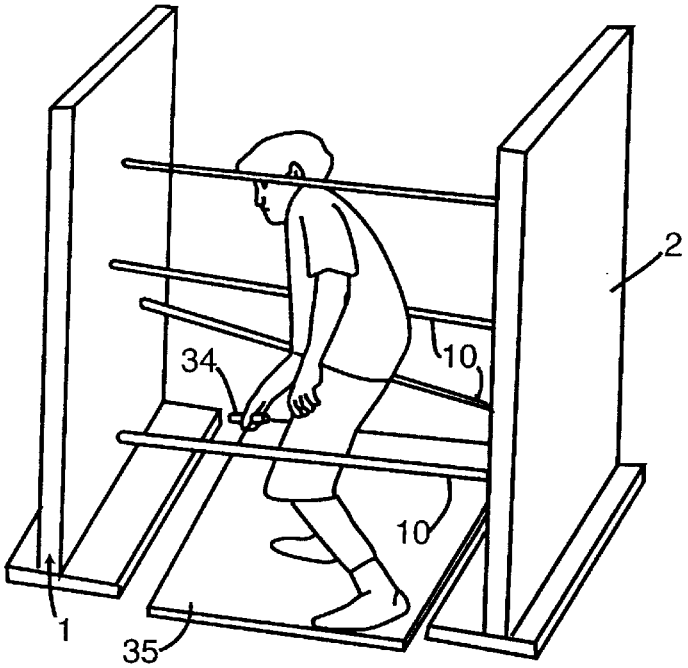
FIG. 4B shows a perspective view of another version the exercise apparatus with the first base and the second base.

In another version of the exercise apparatus, see FIGS. 4A and 4B, one or more head high bases, surrounding the area where the subject stands generate light bars at all heights and orientations relative to the subject. The subject has to duck his head, jump, or move his body sideways to avoid hitting or intercepting the bars.

Figure 5A:
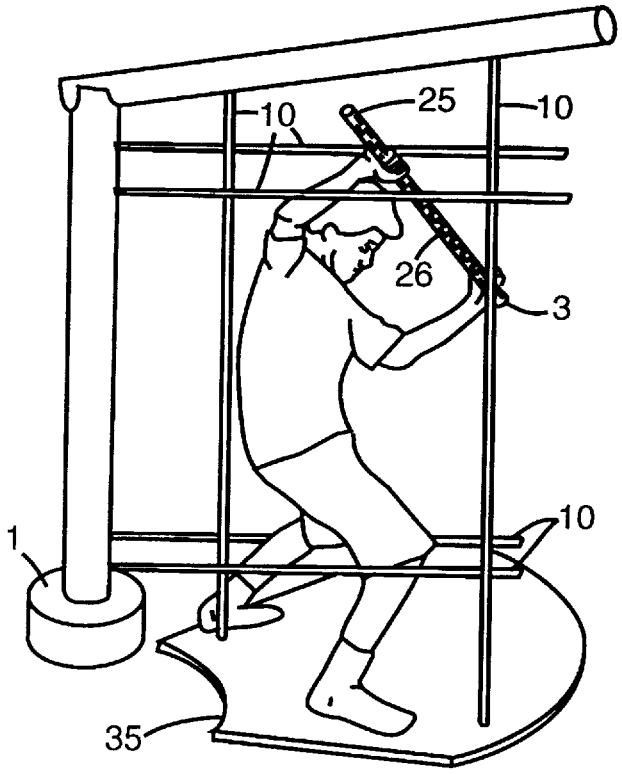
FIG. 5A shows a perspective view of yet another version of the exercise apparatus with the electronic blocker.
Figure 5B:
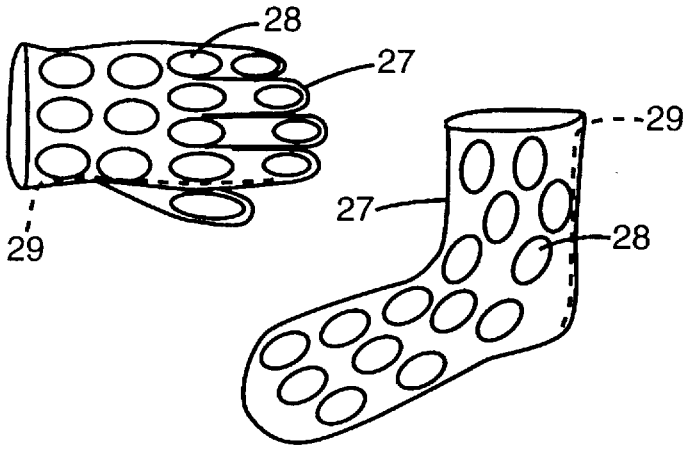
FIG. 5B shows the electronic Blocker in the form of wearable articles such as glove or sock.

In yet another version, see FIG. 5A, the exercise subject uses a hand held blocker to block the light bars. The exercise subject reacts to the sweep of the light bars in the area he stands and uses the blocker to block the light bars.

The logic circuit along with the receiver mechanism, optionally, incorporates remote controllable means by the exercise subject, enabling the exercise subject to alter sweep rate and other parameters of the sweep by a hand held remote control (34), preferably using infrared means.

Preferably the area where the exercise subject stands has padding means to assist in the jump as well as to cushion his fall from the jump. (35)

Although the present invention has been described in considerable detail with reference to certain preferred versions thereof, other versions are possible. Therefore, the spirit and scope of appended claims should not be limited to the description of the preferred versions contained herein.

What is claimed is:

1. An agility exercise apparatus for an exercise subject, the apparatus comprising:

(a) a plurality of bases positioned around an area suitable to be occupied by the exercise subject; and (b) each base having a light source generating a light beam, a haze creating means for converting the light beam to a form of a visually appearing solid light bar which is visible to the exercise subject and which emanates from the light source across at least a portion of the area, and a means enabling the light bar to sweep over at least a portion of the area; whereby, the exercise subject can interact with the light bars from the plurality of bases for the purpose of agility exercising.

2. The agility exercise apparatus as in claim 1, further comprising:

(a) a first base having the light bar generating means, a logic circuit, a light bar sweep control means, the haze creating means, an audio means, and a receiving mechanism;

(b) a second base having light bar sweep obstruction detection means, and a transmit mechanism; and (c) whereby, the light bar sweep obstruction detection means, sensing obstruction of light bars by the exercise subject, the second base transmitting a signal via the transmit mechanism, the first base receiving mechanism receiving the signal, the logic circuit controlling the light bar sweep control means by stopping the motion of the light bar, and generating an advisory indication via the audio means.

3. The agility exercise apparatus as in claim 2, wherein the light bar generating means further comprising:

(a) a conical mirror assembly, with an inner conical mirror, with its reflecting surface on the outside, and an apex end and a flare end, and an outer conical mirror, with its reflecting surface on the inside and with a cutoff apex end and a flare end, substantially surrounding the inner conical mirror and their surfaces being substantially parallel to each other, the inner conical mirror attached to the outer conical mirror by plates near its flare end, the outer conical mirror attached to the conical mirror assembly housing at its cutoff end; and (b) the assembly having a flat mirror, whereby, a pencil beam of light when pointed at the flat mirror is reflected to the apex end of the inner conical mirror, is dispersed and reflected in a 360 degree angle to the inner surface of the outer conical mirror and is reflected again, resulting in the light bar with an annular construction coming out of the assembly.

4. The agility exercise apparatus as in claim 2, wherein, the logic circuit and the light bar sweep control means providing adjustable rate of sweep and orientation of the light bars in the area.

5. The agility exercise apparatus as in claim 3, wherein, the receiving mechanism and the logic circuit are remotely controllable by the exercise subject.

6. The agility exercise apparatus as in claim 5, wherein at least a portion of the area is padded.

7. The agility exercise apparatus as in claim 2, comprising:

(a) an electronic blocker, which can be selectively moved by the exercise subject;

(b) the blocker having a plurality of light sensors on a substantial portion of its outer surface and a signal transmission mechanism embedded in the blocker, whereby, the light bar when in contact with the blocker, the light sensors sensing the contact of the light bar to the blocker, thereby, the blocker generating a transmit signal;

(c) whereby the transmit signal is received by the receiving mechanism; the logic circuit controls the light bar sweep control means, and responds by affecting the light bar sweep orientation.

8. The agility exercise apparatus as in claim 7, wherein the blocker is in form of a rod.

9. The agility exercise apparatus as in claim 7, wherein the blocker is at least one wearable article.

10. The agility exercise apparatus as in claim 9, wherein the transmit signal from the blocker Is encoded to specify the wearable article the signal emanated from.

11. An agility exercise apparatus for an exercise subject, the apparatus comprising:

(a) a base including a light source;

(b) a visible light bar generated by the light source and emanating from the light source across at least a portion of an area which is adapted to be occupied by the exercise subject, the light bar being visible to the exercise subject, the light bar consisting of one light beam; and (c) means enabling the light bar to sweep over at least a portion of the area, at a rate which allows the exercise subject to interact with the light bar for the purpose of agility exercising.

12. The apparatus of claim 11 comprising light bar sweep obstruction means which senses when the light bar is obstructed.

13. The apparatus of claim 12 comprising audio means for generating an advisory indication when the light bar is obstructed.

14. The apparatus of claim 12 comprising a logic circuit for controlling the means enabling the light bar to sweep and stopping the motion of the light bar when the light bar is obstructed.

15. The apparatus of claim 11 further comprising a haze creating means for enhancing the visibility of the light bar.

16. The apparatus of claim 15 wherein the apparatus is remotely controllable by the exercise subject.

17. The apparatus of claim 11 comprising an electronic blocker which is controllable by the exercise subject, the blocker including at least one sensor for sensing when the blocker intersects the light bar.

18. The apparatus of claim 17 wherein the means enabling the light bar to sweep redirects the light bar when the blocker intersects the light bar.

19. The apparatus of claim 17 wherein the blocker is rod shaped.

20. The apparatus of claim 17 wherein the blocker is at least one wearable article.

21. The apparatus of claim 17 comprising at least two electronic blockers which are controllable by the exercise subject, and each blocker is encoded to specify which blocker intersects the light beam.

22. A method for performing agility exercising by an exercise subject, the method comprising:

(a) generating a visible light bar with a light source, the light bar emanating from the light source across at least a portion of an area, the visible light bar being visible to the exercise subject, the light bar consisting of one light beam, the area being suitable to be occupied by the exercise subject; and (b) sweeping the visible light bar across at least a portion of the area at a rate which allows the exercise subject to interact with the light bar for the purpose of agility exercising.

23. The method of claim 22 including the step of intersecting the light bar with a blocker controllable by the exercise subject.

* * * * *